United States Patent [19]

Millet

[11] Patent Number: 4,508,195

[45] Date of Patent: Apr. 2, 1985

[54] OIL CHANGING AND LUBRICATING APPARATUS

[76] Inventor: Serge D. Millet, 40 Rongail St., Nepean, Ontario, Canada, K2G 0K4

[21] Appl. No.: 500,459

[22] Filed: Jun. 2, 1983

[30] Foreign Application Priority Data

Apr. 22, 1983 [CA] Canada ..... 426504

[51] Int. Cl.[3] ..... F01M 11/04; F16N 25/00

[52] U.S. Cl. ..... 184/1.5; 123/196 R; 137/594; 137/625.18; 184/7.2; 184/28; 184/105 R

[58] Field of Search ..... 184/1.5, 6.28, 7 R, 184/7 A, 7 C, 7 CR, 27 R, 28.31, 105 R, 105 B, 105 C, 106, 7.2–7.4; 123/196 R, 196 A, 196 AB, 196 S; 417/410, 423 R; 137/594, 625, 625.11, 625.17, 625.18

[56] References Cited

U.S. PATENT DOCUMENTS

| | | | |
|---|---|---|---|
| 1,803,601 | 5/1931 | Davis | 184/7.2 |
| 2,003,389 | 6/1935 | Petrie | 184/7.2 X |
| 2,105,761 | 1/1938 | Wood | 184/1.5 |
| 2,175,624 | 10/1939 | Wood | 184/1.5 |
| 2,192,176 | 3/1940 | Bijur | 184/7.3 |
| 2,283,638 | 5/1942 | Klein et al. | 184/105 B |
| 2,651,545 | 9/1953 | Shotton | 417/410 X |
| 2,834,376 | 5/1958 | Hughes | 184/7 C |
| 3,059,583 | 10/1962 | Huber | 417/410 |
| 3,282,380 | 11/1966 | Burrell et al. | 184/1.5 |
| 3,720,287 | 3/1973 | Martel | 184/1.5 |
| 3,842,937 | 10/1974 | Lippay et al. | 123/196 S |
| 4,095,673 | 6/1978 | Takeuchi | 184/106 X |
| 4,193,487 | 3/1980 | Takeuchi | 184/1.5 |
| 4,240,523 | 12/1980 | Nestor et al. | 184/1.5 |

FOREIGN PATENT DOCUMENTS

| | | | |
|---|---|---|---|
| 2231100 | 1/1974 | Fed. Rep. of Germany | 184/1.5 |

*Primary Examiner*—David H. Brown
*Assistant Examiner*—John E. Griffiths
*Attorney, Agent, or Firm*—Dennison, Meserole, Pollack & Scheiner

[57] ABSTRACT

There is disclosed an oil changing and lubricating system for a vehicle comprising a housing connectable to the vehicle, a pump affixed to the housing, the intake of the pump communicating with an oil reservoir for the vehicle and the outlet of the pump being adapted for communication with a receptacle for oil removed from the reservoir when the pump is in use and lubricant inputs mounted on the housing for connection to a supply of lubricant, the inputs communicating with the points of the vehicle requiring lubrication for the delivery of lubricant thereto.

1 Claim, 3 Drawing Figures

OIL CHANGING AND LUBRICATING APPARATUS

BACKGROUND OF THE INVENTION

The present invention relates to an attachment to a motor vehicle and more specifically to an apparatus for facilitating oil changes and chassis lubrication.

When changing the oil and lubricating the chassis of a vehicle, it is of course necessary to access the underside of the vehicle to remove the oil plug from the sump for drainage purposes and to gain access to the grease nipples provided at various points on the chassis for lubricating bearings, joints and so forth. Particularly for those who prefer to do their own oil changes, this can prove awkward if not extremely difficult as well as dirty. There is as well an element of danger if a vehicle is improperly lifted for the purpose of gaining access to the underside. Improper supports have been known to collapse with serious consequences to any one caught beneath the vehicle.

To overcome these difficulties, it has been found advantageous to provide a remote device which communicates with the oil sump and the points of the vehicle requiring lubrication which permits oil changes and chassis lubrications without the necessity of actually accessing the underside of the vehicle.

SUMMARY OF THE INVENTION

Accordingly, it is an object of the present invention to at least partially overcome the disadvantages of the prior art by providing an oil changing and lubricating apparatus which is particularly suitable for changing engine oil and lubricating a vehicle chassis.

A further object of the present invention is to provide a device which eliminates the need to work beneath a vehicle when changing its oil or lubricating its chassis.

A still further object of the present invention is to provide an oil changing and lubricating device which is relatively inexpensive to manufacture and which is easy and safe to use.

In a preferred embodiment, the apparatus described herein comprises a housing which may be located in the engine compartment of the vehicle in a position where it is readily and conveniently accessible. The housing includes a pump, the intake of which communicates with the oil sump and the outlet of which includes a hose which may be led to a waste oil receptacle when the pump is actuated to drain the sump. Mounted on the housing are a plurality of grease nipples each of which communicate by means of a flexible, high pressure hose with the points of the chassis requiring lubrication. Oil changes and chassis lubrications may therefore be easily and readily performed without accessing the underside of the vehicle and in a much more convenient and safe manner than was previously possible.

According to the present invention, then, there is provided an oil changing and lubricating system for a vehicle comprising a housing connectable to the vehicle, pump means affixed to the housing, the intake of the pump means communicating with an oil reservoir for the vehicle and the outlet of the pump means being adapted for communication with a receptacle for oil removed from the reservoir when the pump means is in use, and lubricant input means mounted on the housing for connection to a supply of lubricant, the input means communicating with the point of the vehicle requiring lubrication for the delivery of lubricant thereto.

BRIEF DESCRIPTION OF THE DRAWINGS

The present invention will now be described in greater detail and will be better understood when read in conjunction with the following drawings in which.

DETAILED DESCRIPTION

The present oil changing and lubricating apparatus described hereinafter for the purpose of illustrating an exemplary embodiment thereof is described in the context of and for use in association with a motorized vehicle such as an automobile. It will be appreciated that the present apparatus may find use with virtually any machinery utilizing an internal combustion engine or that requires periodic lubrication of its various components and sub-assemblies.

Figure 1:
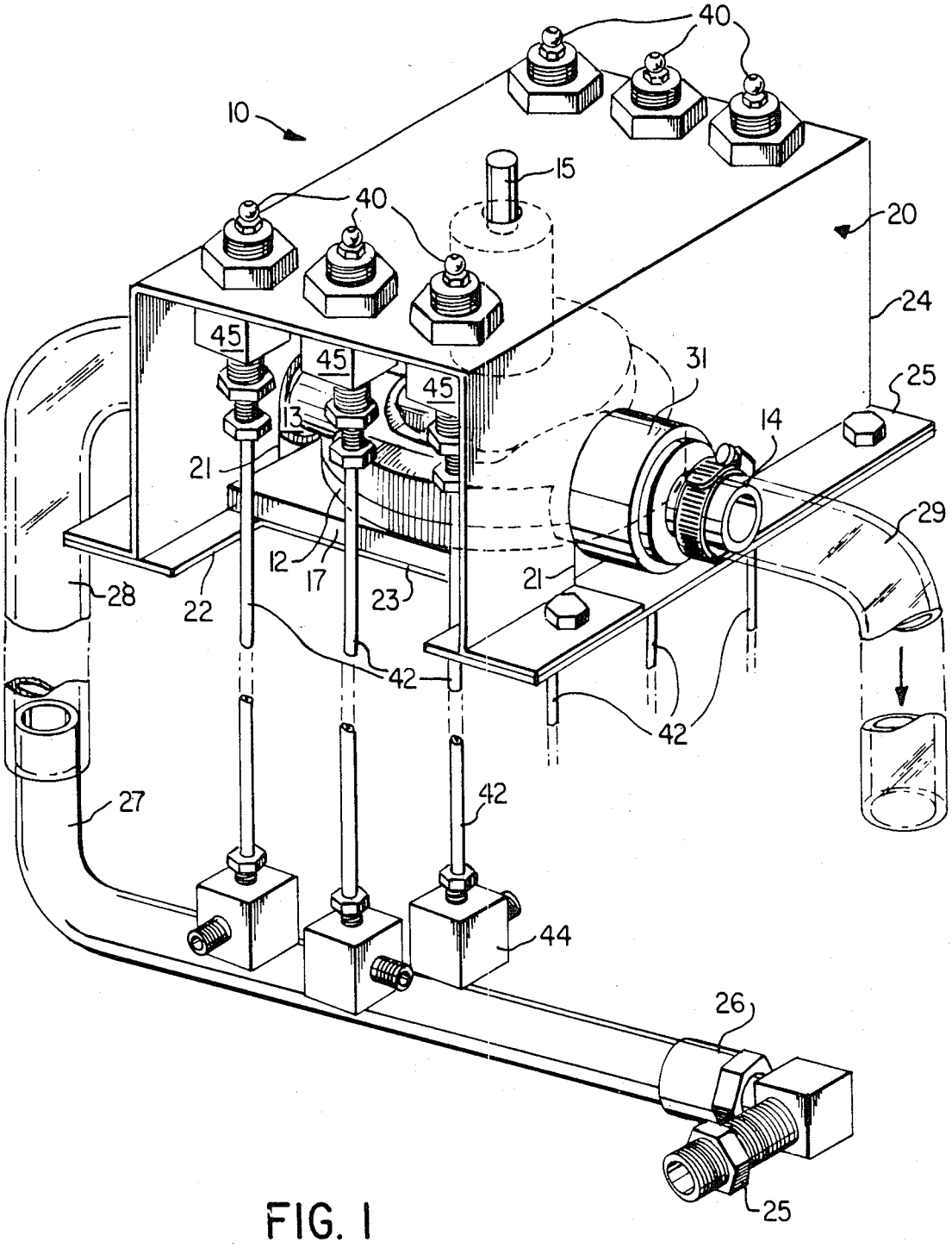
FIG. 1 is a perspective view of the present apparatus as will be described in greater detail hereinafter.
Figure 2:
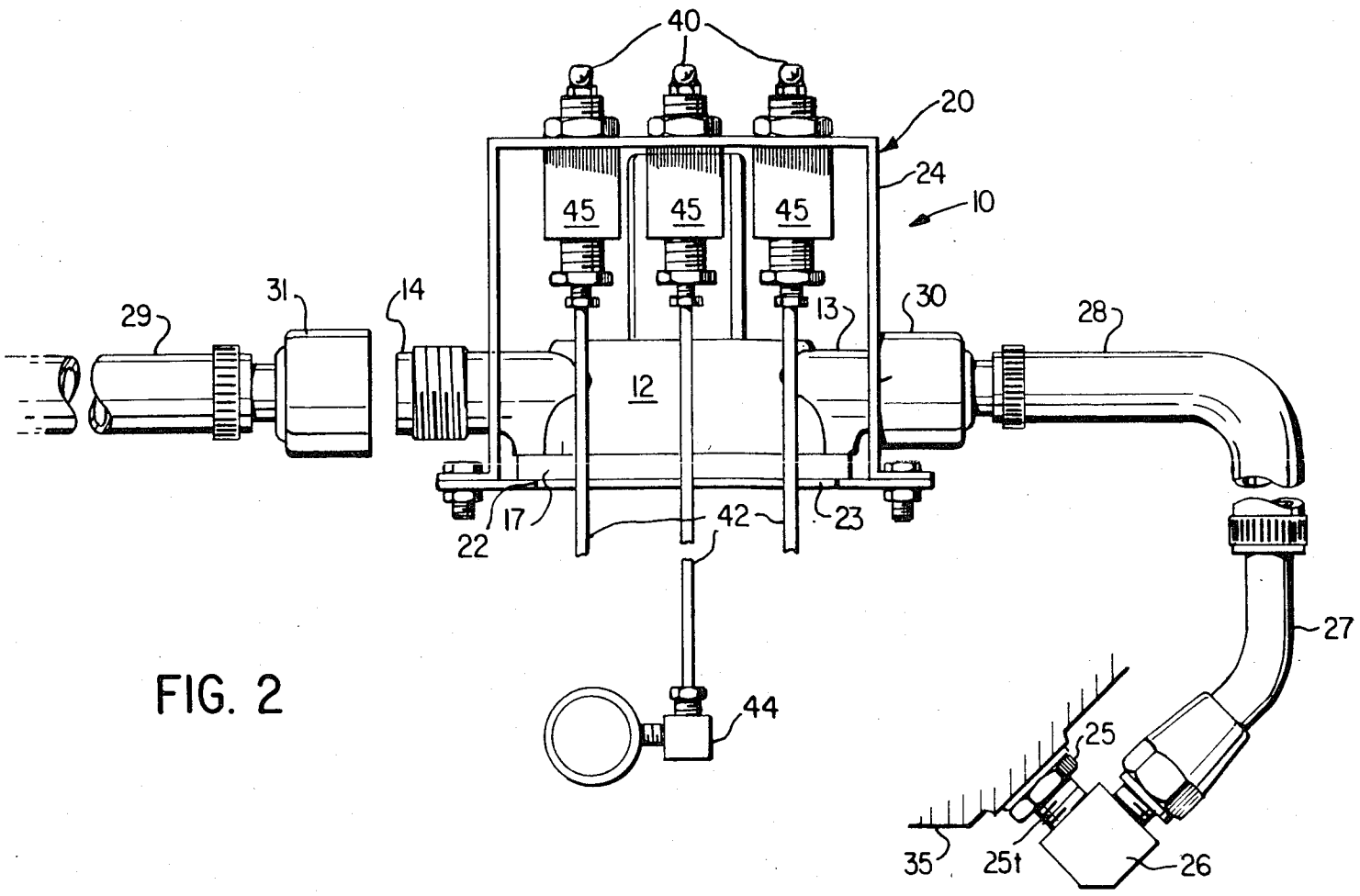
FIG. 2 is a side elevational view of the apparatus of FIG. 1.

With reference now to FIGS. 1 and 2, the present apparatus, indicated generally as at 10, includes an impeller type pump 12 mounted within a housing 20 to have an inlet or intake end of the pump 13 extending outwardly from one side of the housing through an aperture 21 formed therein and an outlet 14 extending outwardly from the opposite side of the housing through a similar aperture.

The intake side of the pump is placed in fluid communication with the vehicle's oil reservoir in a manner to be described below for drawing oil from the reservoir when the pump is activated. The oil pumped from the reservoir is discharged to a waste oil receptacle as will also be described below via the pump's outlet or discharge end 14.

Housing 20 itself comprises a cowling 24 having flanges 25 formed along its lower edges to facilitate its connection by means of screws or other fasteners to a base plate 23. Pump 12 within the housing is supported by one or two resilient pads 17 such as of rubber and the apertures 21 formed into opposite sides of the housing are so dimensioned that the pump is firmly pressed against the pads 17 when cowling 24 is fastened to base plate 23 to secure the pump in place without the need for additional fasteners.

The intake side 13 of pump 12 is connected via tubing means for fluid communication with an oil reservoir 35 of the vehicle, the reservoir typically being the oil sump or pan located at the undermost side of the vehicle's engine. A flexible piece of tubing 28 is clamped or otherwise connected at one end thereof to a threaded connector 30 which mates with the threads formed on intake 13 to provide a fluid tight connection. The other end of tubing 28 is clamped to a length of metal tubing 27, which may be fabricated of copper, having a 90° adaptor 26 provided at the end thereof adjacent sump 35. Adaptor 26 is connected to a threaded bushing 25 which is externally threaded as at **25*t* to threadedly engage an aperture such as the drain hole normally formed in an oil pan to receive an oil plug. Bushing 25 is of course hollow to complete the fluid connection between pump 12** and the oil sump.

Flexible tubing 28 may extend to connect directly with bushing 25 although the use of rigid tubing 27 prevents sagging of the tubing below the vehicle and also provides greater puncture and hazard resistance.

Pump outlet 14 is similarly threaded for engagement to connector 31 which may be identical to connector 30. A length of flexible hose 29 is clamped to connector 31. When not in use, hose 29 may be tucked aside in an out-of-the-way position or the tubing together with connector 31 may be detached from the pump and simply stored away.

When it is desired to drain reservoir 35 for the purpose of changing the engine's oil, hose 29 may be directed to any suitable waste oil receptacle and pump 12 is activated to transfer the contents of the sump to the receptacle. The draining is accomplished in a matter of seconds without the need to access the underside of the vehicle to remove the oil plug.

Pump 12 may include its own prime mover operable from the vehicle's battery or the like, but from a weight and cost point of view, it has been found advantageous to employ a "drill" pump, that is, a pump externally actuatable by rotary means such as a handheld electric drill.

A drill pump, such as pump 12 shown in the drawings hereto, includes an outwardly projecting rotatable spindle 15 connected to the pump's impeller. The pump is mounted within housing 20 so that spindle 15 projects through an aperture formed into the upper surface of cowling 24. The spindle is thereby accessible for grasping by rotary means such as the chuck of a handheld electric drill to thereby activate pump 12.

A drill pump suitable for use with the present apparatus is produced by the Dynaco Corporation under the trade mark LITTLE GIANT.

In addition to changing a vehicle's oil, chassis lubrication is also an important aspect of vehicle maintenance. A vehicle may have a number of lubrication points. Grease nipples are typically provided adjacent each such point to which a grease gun may be attached for the purpose of introducing lubricant to the lubrication point which may be a ball joint, bearing, rod end or the like. As mentioned above, access to the grease nipples is usually from the underside of the vehicle with the attendant disadvantages discussed above.

To overcome this problem, it has been found advantageous to provide the grease nipples themselves on housing 20, interconnecting the nipples with the lubrication points by means of high pressure flexible tubing.

With reference once again to FIGS. 1 and 2, a plurality of lubricant input means such as grease nipples 40 are arranged on cowling 24 adjacent the ends thereof, the number of such nipples corresponding generally to the number of lubrication points on the vehicle. Flexible tubing such as high pressure nylon hoses 42 lead from each nipple 40 to a lubrication point and are connected to the lubrication point by means of 90° adaptors 44. To this end, existing nipples may be removed and the adaptors are threadedly inserted in their place.

To provide clearance for hoses 42 as they leave nipples 40, base plate 23 is recessed as at 22. If more nipples are required, the length of housing 20 may be extended to accommodate, for instance, two rows of nipples at each end thereof.

Figure 3:
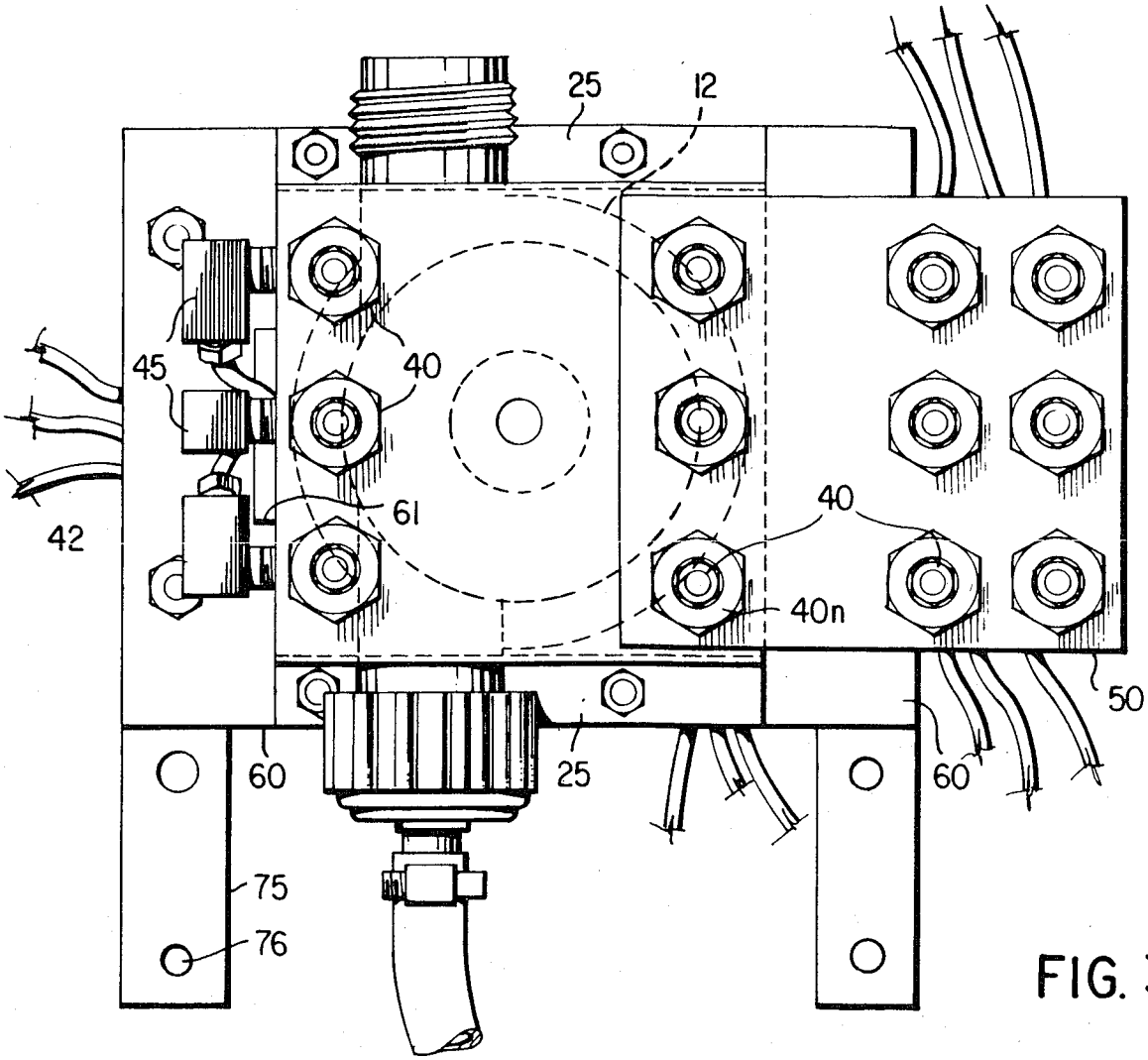
FIG. 3 is a plan view of a further embodiment of the present apparatus.

Alternatively, the extra nipples may be affixed to an add-on plate 50 such as is shown in FIG. 3 illustrating another embodiment of the present apparatus. As will be seen from FIG. 3, plate 50 is formed having, for instance, three apertures (not shown) formed adjacent one edge thereof which fit over grease nipples 40 so that the plate may be connected to the housing by means of the same nuts **40*n* which fasten nipples 40 to cowling 24. Additional grease nipples 40 are mounted onto plate 50** as required.

In FIG. 3, like elements have been referenced by like reference numerals to those used in describing the embodiment of FIGS. 1 and 2. In the embodiment illustrated in FIG. 3, rectangular plates 60 straddle the open ends of housing 20 and are connected to flanges 25. Plates 60 are formed with a recess 61 to define an opening between plate 60 and base plate 23 through which flexible hoses 42 are led. Hoses 42 are connected to grease nipples 40 by means of 90° adaptors 45 rather than directly to the nipples as shown in FIGS. 1 and 2.

It is of course preferable to mount apparatus 10 to the vehicle at a point where it will be readily accessible. It has been found advantageous to mount the apparatus within the vehicle's engine compartment at any suitable location whereby spindle 15 and grease nipples 40 are immediately accessible upon opening of the vehicle's hood. Any suitable bracket such as brackets 75 may be used to mount apparatus 10 within the engine compartment of the vehicle and apertures 76 are provided in brackets 75 for this purpose.

While the invention has been described in terms of two particularly useful embodiments, it will be understood that various equivalents may be used without departing from the scope of this invention as defined by the following claims.

I claim:

1. An oil draining and lubricating system adapted for connection as an accessory to a vehicle having an engine with an oil reservoir and an oil reservoir drain opening and points on said vehicle requiring lubrication, said system comprising:

a drill pump having an intake and an outlet and an outwardly extending spindle adapted for engagement and rotation by a hand-held tool to actuate said drill pump;

a housing including a cowling and a base plate enclosing said drill pump therebetween, said cowling having an upper surface with an aperture through which said spindle extends, a first side surface with an opening through which said intake extends and a second side surface with an opening through which said outlet extends, said base plate and cowling being connected together by means of threaded fasteners;

a resilient pad disposed within said housing between said base plate and said drill pump for supporting said drill pump and securely biasing the same between said base plate and cowling;

tubing means connected at one end to the intake of said drill pump and at the other end to said oil reservoir drain opening to permit oil to be pumped from said reservoir, said tubing means comprising a length of flexible tubing leading from said intake and a length of rigid tubing connected at one end to said flexible tubing and adapted at the other end for threaded connection to said drain opening;

a flexible hose leading away from the outlet of said drill pump for disposing of oil drained from said oil reservoir;

a plurality of grease nipples mounted on said upper surface of said cowling; and a high pressure flexible tube leading from each of said grease nipples for connection to respective ones of said points on said vehicle requiring lubrication to permit the delivery of lubricant thereto.

* * * * *